United States Patent [19]

Brulé

[11] Patent Number: 4,541,531

[45] Date of Patent: Sep. 17, 1985

[54] ROTARY SEPARATOR

[75] Inventor: Paul L. Brulé, Plainwell, Mich.

[73] Assignee: LaRos Equipment Company, Portage, Mich.

[21] Appl. No.: 520,102

[22] Filed: Aug. 4, 1983

[51] Int. Cl.[4] ..... B07B 13/04

[52] U.S. Cl. ..... 209/664; 209/394; 209/683

[58] Field of Search ..... 209/284, 392, 393, 394, 209/44.3, 660, 664, 667, 668, 683, 687, 689, 690

[56] References Cited

U.S. PATENT DOCUMENTS 196,456 10/1877 Howard ..... 209/394
3,151,813 10/1964 D'Apolito ..... 209/687
4,141,451 2/1979 Lapointe ..... 209/664

FOREIGN PATENT DOCUMENTS 1010581 11/1965 United Kingdom ..... 209/664

*Primary Examiner*—Robert B. Reeves
*Assistant Examiner*—Donald T. Hajec
*Attorney, Agent, or Firm*—Flynn, Thiel, Boutell & Tanis

[57] ABSTRACT

A rotary separator is disclosed which utilizes a rotating drum having a plurality of radially elongated slots therein that lead radially outwardly from a central tumbling chamber. A mixture of molded parts and molding runners is placed inside the central chamber. When the drum rotates, the runners fall through the slots and the molded parts remain within the central chamber.

7 Claims, 6 Drawing Figures

FIG. 1
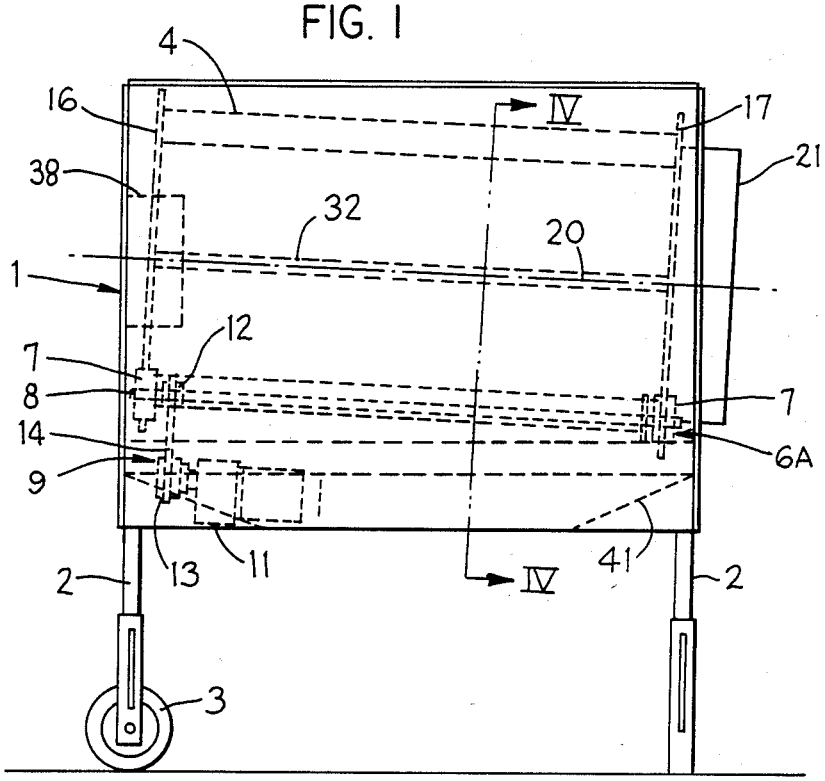
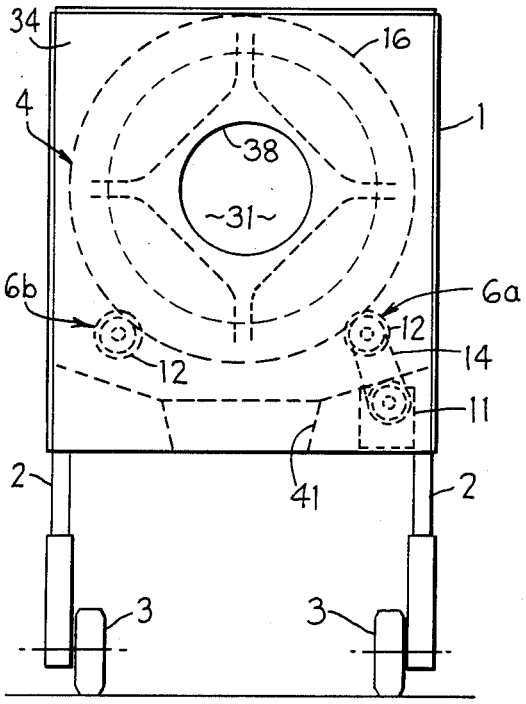
FIG. 2
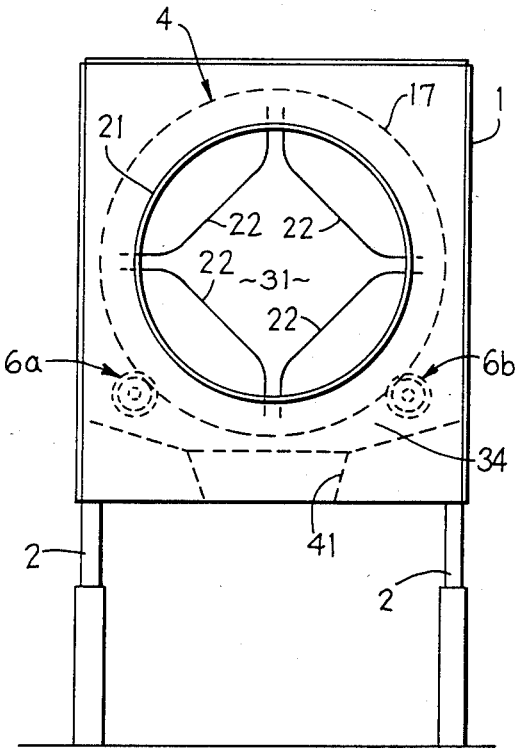
FIG. 3

ROTARY SEPARATOR

FIELD OF THE INVENTION

This invention relates to a rotary separating device particularly adapted for receiving intermixed, broken-apart plastic runners and molded plastic parts for effecting separation thereof.

BACKGROUND OF THE INVENTION

In the molding of plastic parts, it is well known to form a plurality of molded parts in a single casting operation by connecting the parts to a common runner. Such molding methods hence produce a mixture of molded parts and runners, and it is thus necessary to separate the runners from the molded parts.

Several types of machines have been designed to separate such mixtures of plastic parts and runners. One such machine uses a pair of end-to-end arranged belts which provides a slot through which a relatively small molded part can drop while larger runners are carried beyond the slot. However, this type of sorting device can only sort runners and molded parts which are considerably different in size, and is thus of limited usefulness.

U.S. Pat. No. 3,789,981 discloses a separating device which utilizes a moving belt having a plurality of fingers projecting therefrom. At one reach thereof, the belt passes upwardly at a steep angle within an enclosure and a mixture of molded parts and runners is introduced onto the belt. The molded parts fall downwardly through the fingers and are collected below, whereas the runners are caught by the fingers and carried by the belt to a separate container. This device is effective to sort a variety of molded parts and runners of different relative sizes, but is not always effective to sort such mixtures where the molded parts and runners have very similar dimensions, except that the runners are considerably longer than the molded parts.

Accordingly, it is an object of the present invention to provide an apparatus for automatically separating molded parts from runners produced in the molding of said molded parts.

It is a further object of the invention to provide a rotary separator which can be readily adjusted to accommodate mixtures of molded parts and runners having different relative sizes.

It is an additional object of the invention to provide a rotary separator which is portable and has a simple mechanical structure.

Other objects and purposes of the invention will be apparent to persons skilled in the art upon reading the following specification and the accompanying drawings.

BRIEF DESCRIPTION OF THE DRAWINGS

FIG. 1 is a side view of a rotary separator embodying the invention, with interior parts thereof shown in phantom.

FIG. 2 is a back view of the rotary separator shown in FIG. 1.

FIG. 3 is a front view of the rotary separator shown in FIG. 1.

SUMMARY OF THE INVENTION

Figure 4:
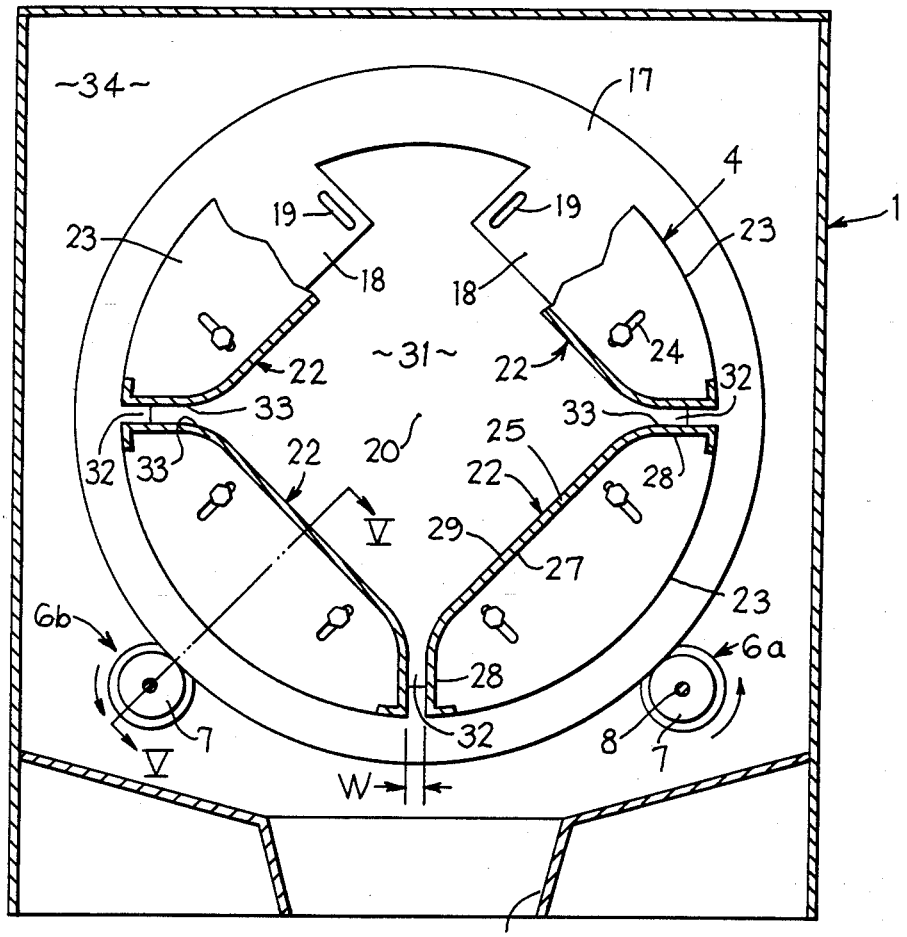
FIG. 4 is an enlarged sectional view taken along line IV—IV in FIG. 1.
Figure 5:
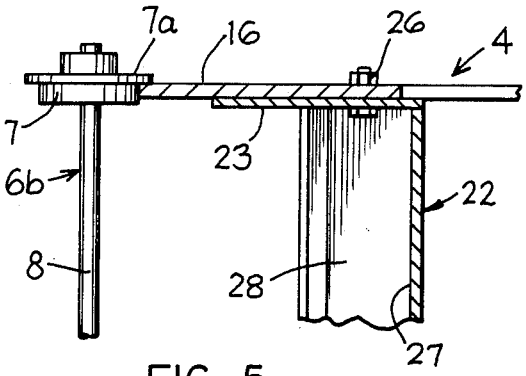
FIG. 5 is a fragmentary sectional view taken along line V—V, in FIG. 4.

The present invention provides a rotary tumbler separator wherein tumbling is accomplished within a rotatable drum. The rotatable drum has a central chamber therein into which the mixture of parts to be separated is placed. The drum further has a plurality of radially extending, radially elongated slots which extend from the central chamber. Upon rotation of the drum, the parts having the critical dimension are tumbled and eventually expelled through the slots, whereas parts having a larger critical dimension are unable to fit through the slots. The radially elongated slots prevent parts having the larger critical dimension from twisting through the slots if such parts are of suitable shape to twist through a shallow aperture. The term "critical dimension" as used herein means the minimum one of either the length, width, or thickness of the part that either allows that part or runner to pass through the slots or prevents that part or runner from passing through the slots.

DETAILED DESCRIPTION

Referring now to FIG. 1 of the drawings, a preferred embodiment of the rotary separator of the invention includes a substantially rectangular separator housing 1 supported by four legs 2 at the lower corners thereof. A pair of wheels 3 are respectively mounted on the two front legs 2 so that the entire apparatus can be transported.

A tumbler drum 4 is rotatably supported within the housing 1 by a pair of rotatable support assemblies 6*a* and 6*b*. Each of these support assemblies 6*a*, 6*b* comprises a pair of flanged wheels 7 mounted at opposite axial ends of a rotatable shaft 8 which is disposed at a slight incline relative to the horizontal. A pulley system 9 is connected to the shaft 8 of the rotatable support assembly 6*a* for driving the shaft 8 in response to the action of a motor 11 disposed on the bottom of the housing 1. The pulley assembly includes an upper pulley 12 mounted on the shaft 8 for integral rotation therewith, a lower pulley 13 adapted to be directly rotated by the motor 11, and a belt 14 mounted on the pulleys 12,13 for transmitting rotation therebetween.

The structure of the tumbler drum 4 is shown in detail in FIGS. 2 through 5. The drum 4 has a pair of circular back and front end plates 16 and 17 which are rotatably supported at opposite lateral sides thereof by the pulleys 7 associated with the support mechanisms 6*a* and 6*b*. The front plate 17 comprises an annular plate or ring having a plurality of substantially radially inwardly extending brackets 18 formed thereon. Each bracket 19 has a pair of parallel, substantially radially extending mounting grooves 19 formed therein. The back plate 16 is of the same construction as the front plate 17.

The back and front plates 16 and 17 respectively are fixedly connected together by a plurality, here four, of vanes or trays 22 disposed in a circular array around the rotational axis 20 of the drum. Each tray 22 extends axially between the plates 16 and 17 and, at opposite ends thereof, is provided with radially extending end brackets 23 having grooves 24 therein. The location of the grooves 24 corresponds to the location of the grooves 19 in the brackets 18 of the plates 16,17, whereby the trays 22 are fixedly mounted to the associated brackets 18 by bolts 26 or other appropriate fasteners.

Each tray 22 includes an axially elongated channel 25 which extends axially between the brackets 23. This channel 25 opens radially outwardly away from axis 20 and comprises a central portion 27 and a pair of radially extending side or leg portions 28 which are continuous with and on opposite sides of the central portion 27. The central portions 27 of the four trays 22 as shown in FIG. 4 together define interior flat walls 29 of a central, axially extending drum chamber 31. The side portions 28 of each tray 22 are bent, through intermediate curved portions 33, at obtuse angles relative to the central portion 27 so that the side portions 28 extend radially outwardly.

The trays 22 are uniformly angularly spaced around the axis 20, and are circumferentially spaced apart from each other as shown in FIG. 4 such that the opposed edge portions 28 of adjacent trays 22 define a narrow radially extending outlet slot 32. Each outlet slot 32 is defined by a pair of radially outwardly extending, elongated, parallel walls as defined by the opposed edge portions 28. The slots 32 have a width W equal to or less than the radial length of the slots 32. Preferably, the radial length of the slots 32 is at least twice as great as the width W. The slots 32 generally extend along substantially the entire axial length of the drum 4, as shown in FIG. 1. Each of the slots 32 is in direct communication with the central chamber 31 at the inner end thereof and in direct communication at the outer end thereof with an outer chamber 34 defined between the outer periphery of the drum 4 and the inner periphery of the housing 1.

As illustrated by FIG. 4, the curved wall portions 33 which provide the transition between the flat chamber walls 29 and the flat slot-defining walls 28 hence define a flared mouth or transition from the slot 32 into the chamber 31 and thus facilitate and assist in the alignment of parts or runners which are to be passed through the slot. These curved transition walls 33 provide a smooth curvature between the walls 29 and 28, and while the curvature preferably should not be extremely sharp so as to approach or resemble a sharp corner, nevertheless the curvature should also not be so large as to permit wedging of the parts in the inlet ends of the slots.

Regarding the central chamber 31, the walls 29 are preferably planar as shown in FIG. 4, thus giving the central chamber 31 an essentially uniform polygonal (i.e. rectangular) cross section. The walls 29 may be slightly radially inwardly curved (i.e. concave), but preferably should not be radially outwardly curved (i.e. convex). If the walls 29 are convex such that the cross-sectional shape of the central chamber 31 becomes rounded, then the tumbling action within the drum 4 decreases and the runners become difficult to separate out. On the other hand, the flat walls 29 assist in axially aligning the runners in the central chamber 31 during tumbling and thereby allow the runners to move radially outwardly through the slots 32.

As shown in FIGS. 1 to 5, the front and back plates 16 and 17 respectively of the drum 4 are in tangent contact with the four wheels 7. The flanges **7*a* of the wheels 7 are disposed axially outwardly of the plates 16 and 17 and overlap the associated edge thereof, thereby securing the drum 4 from axial movement within the housing 1**.

As shown in FIG. 1, a cylindrical product outlet spout 21 is positioned axially outwardly of the front plate 17 and has a diameter approximately equal to the inner diameter of the annular plate 17. The outlet spout 21 is fixed to and preferably extends outwardly from the front wall of the housing as shown in FIGS. 1 and 3.

As shown by FIGS. 1 and 2, a cylindrical inlet spout 38 is fixed to housing 1 and coaxially aligned with the other end of chamber 31.

A mixture of molded parts 36 and runners or sprues 37 can be introduced into the central chamber 31 through the inlet spout 38. The apparatus of the invention is particularly adapted for separating a mixture of molded parts 36 and runners 37, such as illustrated by way of example in FIG. 6. Typically, the runner 37 is of much greater length than the molded part 36, but the minimum or critical dimension of the runner 37 is slightly less than the minimum dimension of the molded part 36.

In order to adjust the rotary separator of the invention to the dimensions of the objects to be separated, the width W of the slots 32 can be adjusted by changing the mounting position of the trays 22 on the plates 16 and 17. The grooves 19 and 24 are parallel and elongated in substantially radial directions for this purpose, as shown in FIG. 4, so that the trays 22 can be adjustably moved radially so as to vary the slot width W. The width W is accordingly adjusted so that it just exceeds the minimum dimension of the runner, whereby the runners 37 can slide down the adjacent walls 29 into the associated slot 32, then fall through the slot 32 into the outer chamber 34. The molded part 36 has a critical dimension slightly greater than the width W and therefore cannot pass through the slot 32. Even if the molded part has an unusual shape, such as an L-shape, which would allow it to twist through a shallow aperture or hole having a width less than the critical dimension of the molded part, this can not occur with the separator of the present invention because the slots 32 are elongated in the radial direction. Accordingly, only the runners 37 can pass through the slots 32. The runners 37 typically comprise an elongated central stem portion 38 which has a plurality of radially extending branch portions 39 extending therefrom.

Figure 6:
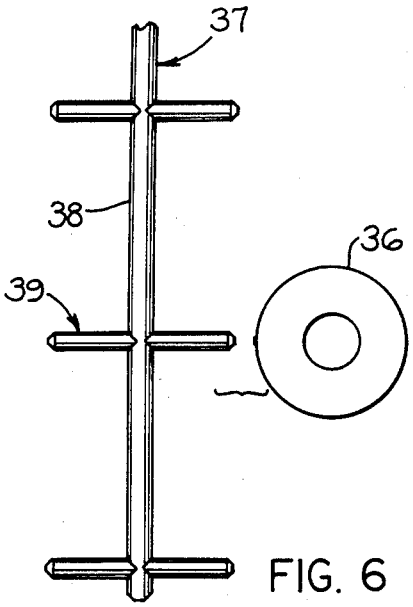
FIG. 6 is a plan view of a molded part and runner which can be separated using the apparatus of the present invention.

The runners and molded parts are preferably already detached from each other, as shown in FIG. 6, when deposited in the separator. The motor 11 is then operated to drive the pulley mechanism 9, which in turn causes rotation of the shaft 8 and flanged wheels 7 of the support assembly **6*a*. The rotation of the wheels 7 of support assembly 6*a* causes rotation of drum 4 in the direction indicated by the arrow in FIG. 4. The intermixed parts and runners deposited in the central chamber 31 are tumbled within the chamber 31 and runners 37 fall out of the slots 32, particularly when each individual slot 32 passes through its lowermost position. The runners 37 which have entered the outer chamber 34 fall through a chute 41 formed on the lower side of the housing 1. The support mechanisms 6*a* and 6*b* are preferably set at a slightly incline relative to the horizontal so that the drum 4 tilts slightly downwardly from the back end to the front end thereof as shown in FIG. 1. The tumbled molded parts 36 thereby eventually travel the entire axial length of the drum 4 and either fall out of the apparatus through the chute 21** or are manually removed. If necessary, the molded parts obtained in this fashion can be sent through the apparatus again in order to remove any remaining runners intermixed therewith. In this manner, the apparatus of the present invention efficiently separates the molded parts from the runners, even when the critical (i.e. minimum) dimensions of the molded parts and runners are very close to each other.

The means for rotating the drum 4 can be of any suitable type, although the simple arrangement described above is preferred. With reference to the number of slots 32, as few as two slots or as many as about eight slots can be employed, although four slots are preferred. When the number of slots approaches eight, the convergence between the adjacent interior walls 29 decreases, and this in turn decreases the tumbling action. The preferred range of slots is three to six.

Although the apparatus of the invention is particularly adapted for the separation of intermixed molded parts and runners, the apparatus of the invention can separate into two groups a plurality of different types of objects having different critical dimensions. The overall size of the rotary separator of the invention is not critical, and can vary within a wide range.

While a specific embodiment of the invention has been shown herein for purposes of illustration, it will be recognized that variations may be employed for adapting the apparatus to other specific applications without departing from the scope of the invention.

The embodiments of the invention in which an exclusive property or privilege is claimed are defined as follows:

1. A rotary separator in the form of a rotatable drum adapted upon rotation thereof to separate two types of intermixed objects of different sizes disposed within said drum by expelling therefrom objects of one of said types separately from objects of the other of said types, comprising;

a rotatable drum including frame means and a plurality of axially extending, channel-like members mounted on said frame means in a circular array about and radially spaced from the rotational axis of said drum so as to define therebetween an enlarged central chamber, said channel-like members being circumferentially spaced apart such that opposed edge portions of each adjacent pair of said members extend radially outwardly and form therebetween an axially elongated slot which opens radially outwardly from said central chamber, said opposed edge portions being defined by a pair of parallel radially extending walls so that said slot is radially elongated, the radial length of said slot being equal to or greater than the width thereof;

said frame means comprising a pair of end plates, each said plate comprising an annular plate portion and a plurality of bracket portions extending radially inwardly from said annular plate portion, each of said channel-like members being mounted on and extending axially between associated bracket portions of said pair of plates;

each of said members having a pair of radially extending brackets at opposite axial ends thereof, said brackets having a plurality of elongated slots therein, and said bracket portions of said plates have elongated slots therein alignable with the elongated slots of said brackets, and fastening means projecting through aligned pairs of said slots for radially adjustable securing said members to said plates; and means for rotating said drum for tumbling the objects within said chamber, whereby one of said types are discharged through said slots while objects of the other of said types are not discharged through said slots.

2. A rotary separator in the form of a rotatable drum adapted upon rotation thereof to separate two types of intermixed objects of different sizes disposed within the drum by expelling therefrom objects of one of the types separately from objects of the other of said types, comprising:

a rotatable drum including frame means and a small number of elongated and axially extending channel-like members mounted on said frame means in a circular array about and radially spaced from the rotational axis of said drum so as to define therebetween a substantially polygonal boundary wall which defines therein an enlarged central chamber, said polygonal boundary wall being defined by a number of planar sidewalls equal to the number of channel members;

each said channel-like member having a single substantially flat and planar bottom wall which in its widthwise dimension extends generally circumferentially of the drum and defines one of the sidewalls of the polygonal boundary wall, each said channel-like member also having a pair of edge walls which extend longitudinally of the channel-like member along the opposite lengthwise edges of the bottom wall and project therefrom generally radially outwardly of said drum, said channel-like members being circumferentially spaced apart such that the opposed edge walls of each adjacent pair of said channel-like members extend radially outwardly and form therebetween an axially elongated slot which opens radially outwardly from said central chamber, said opposed edge walls being substantially parallel as they project radially outwardly so that said slot is radially elongated, the radial length of said slot being equal to or greater than the width thereof, and said edge walls having a radial extent which is small relative to the widthwise extent of said bottom wall;

adjustable mounting means for attaching said channel-like members to said frame means for enabling said channel-like members to be selectively radially displaced to adjust the cross-section of said central chamber and hence vary the width of said slots for controlling the size of the object discharged therethrough; and means for rotating said drum for tumbling the objects within said chamber, whereby one of said types are discharged through said slots while objects of the other of said types are not discharged through said slots.

3. A separator according to claim 2, wherein said frame means includes a pair of spaced end plates which are secured to opposite ends of said channel-like members, and said mounting means including a bracket structure for securing the opposite ends of said channel-like members to said end plates, said mounting means also including a radially elongated adjustment slot and a releasable fastener associated therewith for radially adjustably securing each end of one said channel-like member to one of said end plates.

4. A separator according to claim 2, wherein the bottom wall of the channel-like member extends generally perpendicular to a radial line which passes through said bottom wall substantially at the midpoint thereof.

5. A separator according to claim 2, wherein each said channel-like member has small rounded corners where the edge walls join to the bottom wall.

6. A separator according to claim 2, wherein the number of channel-like members is between three and six.

7. A separator according to claim 6, wherein the number of channel-like members is four, and the central chamber has a substantially square cross-section defined by the four planar bottom walls of the four channel-like members.

* * * * *